US009330652B2

(12) United States Patent
Jensen et al.

(10) Patent No.: US 9,330,652 B2
(45) Date of Patent: May 3, 2016

(54) ACTIVE NOISE CANCELLATION USING MULTIPLE REFERENCE MICROPHONE SIGNALS

(71) Applicant: Apple Inc., Cupertino, CA (US)

(72) Inventors: Thomas M. Jensen, San Francisco, CA (US); Vladan Bajic, San Francisco, CA (US); Andrew P. Bright, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 340 days.

(21) Appl. No.: 14/035,662

(22) Filed: Sep. 24, 2013

(65) Prior Publication Data

US 2014/0086425 A1 Mar. 27, 2014

Related U.S. Application Data

(60) Provisional application No. 61/705,041, filed on Sep. 24, 2012.

(51) Int. Cl.
*G10K 11/16* (2006.01)
*G10K 11/178* (2006.01)

(52) U.S. Cl.
CPC ..... *G10K 11/16* (2013.01); *G10K 11/1784* (2013.01); *G10K 2210/1081* (2013.01); *G10K 2210/3018* (2013.01); *G10K 2210/3056* (2013.01)

(58) Field of Classification Search
CPC ..... G10K 2210/1081
USPC ..... 381/71.11, 74; 341/118
See application file for complete search history.

(56) References Cited

U.S. PATENT DOCUMENTS

| | | | | |
|---|---|---|---|---|
| 8,238,575 | B2 | 8/2012 | Buck et al. | |
| 8,243,941 | B2 | 8/2012 | Togawa et al. | |
| 2010/0124337 | A1* | 5/2010 | Wertz | G10K 11/1782 381/71.11 |
| 2010/0177905 | A1 | 7/2010 | Shridhar et al. | |
| 2011/0129098 | A1 | 6/2011 | Delano et al. | |
| 2011/0158419 | A1 | 6/2011 | Theverapperuma et al. | |
| 2012/0308027 | A1* | 12/2012 | Kwatra | G10K 11/1784 381/71.11 |
| 2014/0062738 | A1* | 3/2014 | Wu | H03M 1/0626 341/118 |

OTHER PUBLICATIONS

Das, Kunal K., "Frequency-Domain Block Filtered-x NLMS Algorithm for Multichannel ANC", *First International Conference on Emerging Trends in Engineering and Technology*, Jul. 16-18, 2008, DOI 10.1109/ICETET.2008.101, pp. 1293-1297.

Efron, A. J., et al., "Wide-Area Adaptive Active Noise Cancellation", *IEEE Transactions on Circuits and Systems—II: Analog and Digital Signal Processing*, vol. 41, No. 6, Jun. 1994, pp. 405-409.

(Continued)

*Primary Examiner* — Md S Elahee
(74) *Attorney, Agent, or Firm* — Blakely, Sokoloff, Taylor & Zafman LLP

(57) ABSTRACT

In one aspect, multiple adaptive W filters and associated adaptive filter controllers are provided that use multiple reference microphone signals to produce multiple, "component" anti-noise signals. These are gain weighted and summed to produce a single anti-noise signal, which drives an earpiece speaker. The weighting changes based on computed measures of the coherence between content in each reference signal and content in an error signal. Other embodiments are also described and claimed.

21 Claims, 11 Drawing Sheets

CROSS SECTION OF PORTABLE PERSONAL AUDIO LISTENING DEVICE

(56) References Cited

OTHER PUBLICATIONS

Kuo, Sen M., et al., "Active Noise Control: A Tutorial Review", *Proceedings of the IEEE*, vol. 87, No. 6, Jun. 1999, pp. 943-973.
Tu, Yifeng, "Multiple Reference Active Noise Control", *Thesis Submitted to the Faculty of the Virginia Polytechnic Institute and State University, Master of Science in Mechanical Engineering*, Mar. 1997, Blacksburg, Virginia USA, 108 pages.
Widrow, Bernard, et al., "Adaptive Noise Cancelling: Principles and Applications", *Proceedings of the IEEE*, vol. 63, No. 12, Dec. 1975, ISSN: 0018-9219, pp. 1692-1716 and 1 additional page.

* cited by examiner

ACTIVE NOISE CANCELLATION USING MULTIPLE REFERENCE MICROPHONE SIGNALS

This application claims the benefit of the earlier filing date of provisional application No. 61/705,041 filed Sep. 24, 2012.

FIELD

The embodiments of the invention relate to active noise control or active noise cancellation (ANC) systems that use multiple reference microphone signals.

BACKGROUND

In portable consumer electronics personal listening audio devices, such as cellular phones, smart phones, and loose fitting headsets known as ear buds that may be connected to tablet computers and laptop computers, the listening device often does not have sufficient passive noise attenuation. For instance, the more comfortable, loose fitting ear bud is often preferred, which provides lesser passive ambient noise reduction than a larger and heavier yet better sealing outside-the-ear unit, or a completely sealed inside-the-ear-canal earphone. In addition, a user is often moving around with such a listening device, e.g. while walking or jogging. In the case of a smart phone that is being used in handset mode (against the ear), the phone is held against the user's ear differently by different users, and also tends to move around during a phone call. These user-specific factors change the acoustic environment or acoustic loading of the listening device in real-time. As a result, the use of an adaptive ANC system has been suggested, to help improve the user's listening experience by attempting to produce a quieter environment.

The ANC system produces an "anti-noise" sound wave through an earpiece speaker (e.g., the "receiver" in a smartphone handset, or the speaker driver within an earphone housing) in such a way, that is, having a certain spectral content, that is intended to destructively interfere with or cancel the ambient or background noise sound that would otherwise be heard by the user. Attempts have also been made to improve the performance of the ANC system in personal listening devices, by making the system adaptive. An adaptive filter and an adaptive controller are provided, which aim to model the different parts of the acoustic environment that is surrounding the user, or the various acoustic paths leading to the user's eardrum. Based on sensing the acoustic background noise using a reference microphone, and the residual "cancelled" noise using an error microphone, a feedforward ANC system adapts or continuously changes the state of its adaptive filter in real-time so as to produce an anti-noise signal that better cancels the offending or unwanted noise.

SUMMARY

It has been found that in a practical feedforward ANC system that is suitable for personal listening audio devices, there are certain limitations such as the limited precision of the adaptive filter (e.g., a finite impulse response, FIR, digital filter having limited frequency precision), the likelihood of occlusion of the single reference microphone by the user's finger, and the sometimes lack of coherence between the ambient noise picked up by the reference microphone and the disturbance (ambient noise that has leaked into the user's ear canal and can be heard by the user in the absence of sufficient anti-noise). These factors create a complex situation that as a whole may limit the noise cancelling ability of the ANC system in terms of both bandwidth and the amount of attenuation.

An embodiment of the invention is a portable personal listening audio device having ANC circuitry that uses multiple reference signals. These are from multiple reference microphones that together can cover a larger spatial area over which the background acoustic noise can be picked up. The ANC circuitry has multiple adaptive filters where each produces a respective or "component" anti-noise signal, using a respective one of several reference microphone signals. Multiple adaptive filter controllers are provided, wherein each controller is to adjust a respective one of the adaptive filters using an adaptive algorithm engine (e.g., a gradient descent algorithm engine such as a least means squares, LMS, algorithm), based on input from the respective reference microphone signal and an error signal derived from an error microphone output. A coherence-based gain controller (e.g., as part of an adaptive gain control block) computes a measure of the content in the error signal, namely coherence between content in a respective one of the reference microphone signals and an estimate of the disturbance. A difference block may be used to estimate the disturbance, by subtracting an estimate of the anti-noise sound from the error signal. A combiner produces a weighted sum of the component anti-noise signals (that is to then be converted into anti-noise sound), so as to control the disturbance. The weighting of the component anti-noise signals is controlled by the coherence-based gain controller. In other words, the weighting changes based on the computed measures of coherence, to thereby produce a single or final anti-noise signal that drives a speaker and that changes so as to adapt to the user's environment or usage of the device.

In one embodiment, each adaptive filter may be a FIR digital filter (or "W" filter) that has more than 128 taps (e.g., 256 taps or more). These, and some other latency sensitive digital processing blocks such as the combiner, may be implemented in dedicated logic hardware, for example within an audio codec integrated circuit package. The adaptive filter controller may be a least mean squares (LMS) engine that together with the coherence estimators may be implemented as software running on a programmed digital signal processor.

In one embodiment, the error signal is adjusted, before the input to the adaptive algorithm engine, so as to counteract the combiner's weighting of the anti-noise signals. This helps prevent the adaptive algorithm from negating the effect of the weighting.

In yet another embodiment of the invention, the ANC circuitry has a combiner that produces a weighted sum of the reference signals, and a single adaptive filter then produces an anti-noise signal using the weighted sum reference signal (to once gain control the disturbance being ambient sound that is heard by a user). An adaptive filter controller adjusts the coefficients of the adaptive filter, based on the weighted sum reference signal and based on the error signal. A coherence-based gain controller, e.g., as part of an adaptive gain control block, is coupled to the combiner, and computes a respective measure of coherence between content in a respective one of the unweighted reference signals and content in the error signal, namely an estimate of the disturbance, and on that basis adjusts a weighting of the respective reference signal.

In yet another embodiment, the ANC processor has multiple adaptive filters and multiple adaptive filter controllers, respectively, and a combiner that produces a sum of the anti-noise signals produced by the adaptive filters. A coherence-based leakage control block is coupled to each of the adaptive filter controllers, to adjust a weighting factor that is used by the adaptive algorithm engine when computing an update to the filter coefficients of the respective adaptive filter. This adjustment is responsive to having computed a measure of coherency between content in the respective reference signal and the estimated disturbance. The adjustable weighting factor may be represented by a leakage parameter. In particular, the coherence-based leakage control block may have a leakage calculator that determines the respective leakage parameter that is to be used by each of the adaptive algorithm engines (when updating the filter coefficients of the respective adaptive filter.) In this embodiment, there may be no need for adjusting the error signal at the input of the adaptive algorithm engine to counteract the effect of adjusting the coefficient updates.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Figure 1:
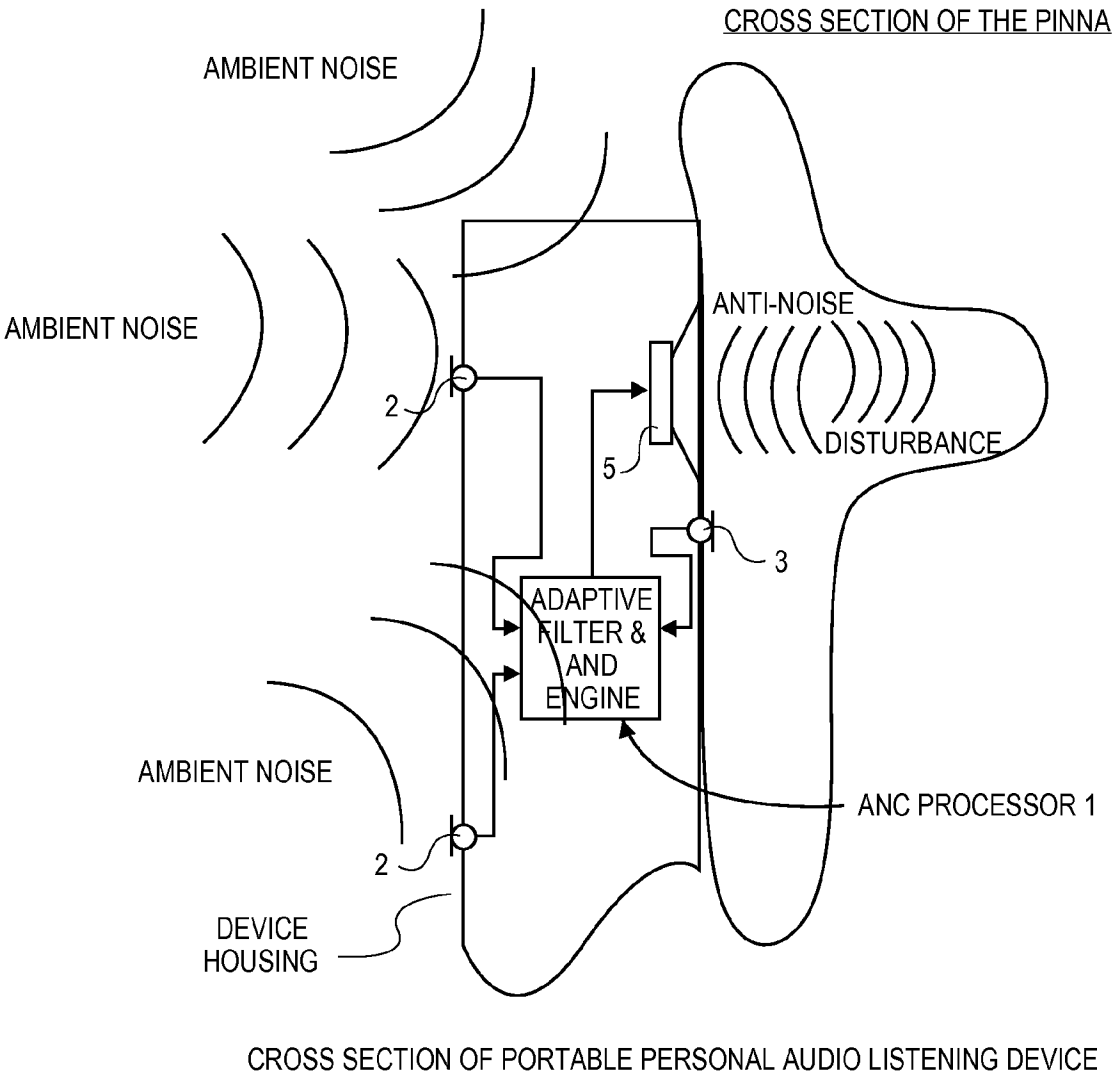
FIG. 1 shows a conceptual block diagram of an example personal audio listening device in which an embodiment of the invention may be implemented.

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description. Regarding the summing junctions shown in the drawings, unless otherwise specified, their inputs are not inverted (or are "positive" inputs).

Figure 2:
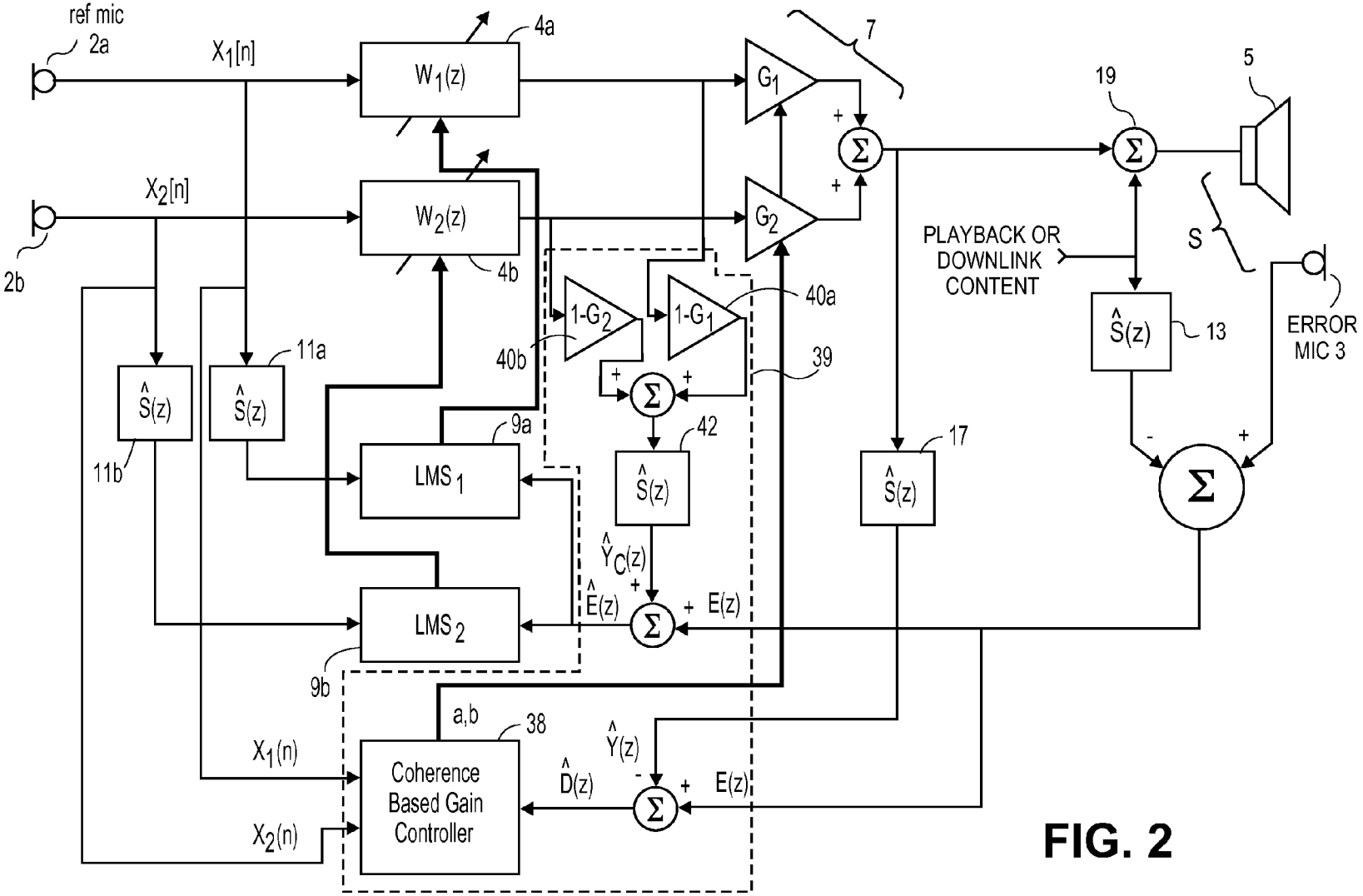
FIG. 2 is a block diagram of an ANC processor in accordance with an embodiment of the invention.

FIG. 1 shows a conceptual block diagram of an example personal audio listening device in which an embodiment of the invention may be implemented, as an ANC processor 1 that uses multiple reference microphones 2. FIG. 2 is a block diagram of an ANC processor 1 in accordance with an embodiment of the invention. The ANC processor 1 implements a feedforward, filtered-X adaptive control noise cancellation algorithm that continuously and repeatedly updates in this example a pair of adaptive filters 4*a*, 4*b* (having transfer functions $W_1(z)$ and $W_2(z)$). The latter models an acoustic system referred to as the primary path for ambient or background noise that reaches an ear of a user. This enables each of the adaptive filters 4 to use a respective reference signal, to produce a respective anti-noise signal. These "component" anti-noise signals are then fed to a combiner 7, which produces a weighted sum using variable gain blocks $G_1$ and $G_2$ as shown, which is then driven through a speaker 5 to produce the anti-noise sound. The use of multiple reference signals, derived from multiple reference microphones 2*a*, 2*b*, respectively, may allow the background noise to be captured more robustly at the same time, at different positions on the external housing of the personal audio device (see FIG. 1). This may, for example, reduce the dependency of the orientation of a mobile phone handset (see FIG. 7) being operated by its user.

The state of each adaptive filter 4*a*, 4*a* including its digital filter coefficients is repeatedly updated by a respective adaptive filter algorithm engine of an adaptive filter controller 9*a*, 9*b*. The adaptive algorithm engine or controller 9 may implement a gradient decent algorithm, e.g. least mean squares (LMS), which is designed to find the proper state or digital filter coefficients that tends to minimize the residual noise or error between the anti-noise sound and the ambient or background noise. This error is reflected in a signal that is derived from the output of an error microphone 3.

A further input to each adaptive controller 9*a*, 9*b* is the reference input, which receives an audio signal derived from that which has been picked up a respective reference microphone 2*a*, 2*b*. These reflect the ambient or background noise. While the LMS algorithm, and in particular, the filtered-x LMS algorithm, is described below, the use of multiple reference signals as described here may also be of benefit with other adaptive ANC algorithms. In the filtered-x LMS embodiment shown here, each reference signal is fed to a reference input of its respective controller 9, after being filtered by the $\hat{S}$ copy block 11. The latter models the secondary path transfer function S(z) as shown in FIG. 2, which encompasses the transfer function between the input to the speaker 5 and the output of the error microphone 3. A further adaptive algorithm engine may be present (not shown), that adapts the secondary path adaptive filter 13, because of changes in the acoustic loading of the speaker 5 (due to various user scenarios such as moving the cellular phone handset around while against the ear, or different levels of partial sealing of an ear bud).

A single error signal is produced here, from the output of the error microphone 3, by subtracting out the playback or downlink audio content (also referred to as user audio) that in this case has also been picked up by the error microphone 3. This may be achieved by passing the user audio through another Ŝ copy filter block 13, before subtracting from the signal output of the error microphone 3. The single error signal may then be fed to the error inputs of the two controllers 9*a*, 9*b*, respectively, through optional pre-shaping filters (not shown). The controllers 9*a*, 9*b* use the error signal in an adaptive control algorithm (e.g., LMS) to adjust the digital filter coefficients of their respective adaptive filters 4*a*, 4*b*.

A coherence based gain controller 38 is to compute measures of the coherence between content in the reference signals and content in the error signal, and on that basis vary the gains applied by the gain blocks of the combiner 7, so as to weight the component anti-noise signals appropriately, in an attempt to emphasize the component anti-noise signal which is likely to provide better noise canceling. In other words, the combiner 7 is to produce a weighted sum of the anti-noise signals that is to then be converted to anti-noise sound, so as to control the background acoustic noise that is heard by the user, wherein weighting of the anti-noise signals changes based on the computed measures of coherence. The gain controller 38 in this case produces two gain values a, b that are applied to the variable gain blocks $G_1$, $G_2$, respectively.

Figure 3:
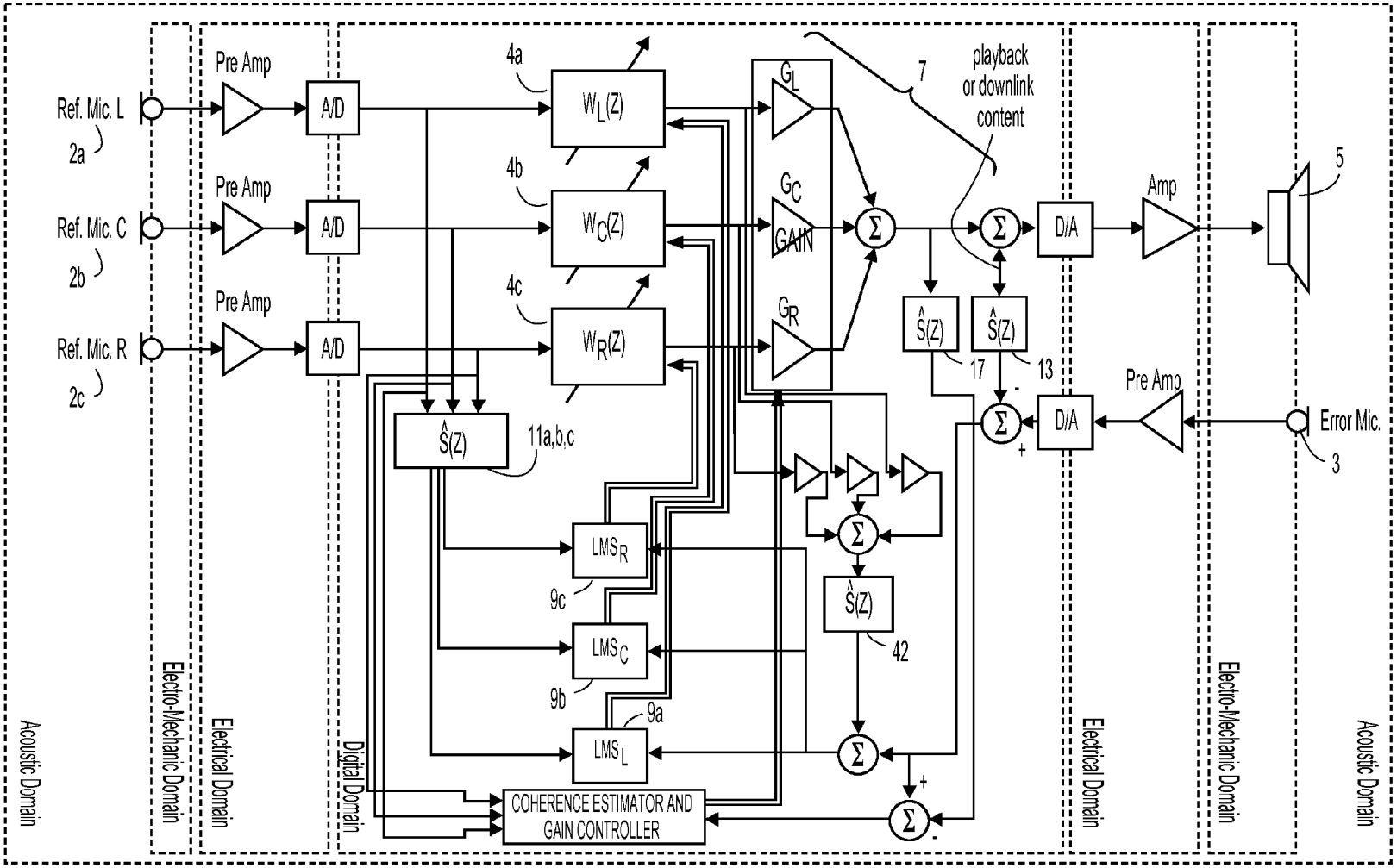
FIG. 3 is a block diagram of an ANC processor in accordance with another embodiment of the invention.

FIG. 3 is a block diagram of an ANC processor in accordance with another embodiment of the invention. In this case, the filtered-x LMS architecture is used separately for each of three reference channels R, L and C, rather than two as in the embodiment of FIG. 2. There are in this case three adaptive filter controllers 9*a*, 9*b*, 9*c* (e.g., $LMS_R$, $LMS_L$, and $LMS_C$) adjusting the respective coefficients of their respective adaptive W filters 4*a*, 4*b*, 4*c*, producing three component anti-noise signals. The combiner 7 here produces a weighted sum of three anti-noise signals, one for each of the channels R, L and C, that is then converted to anti-noise sound by earpiece speaker 5 (e.g., receiver), so as to control the "disturbance" or background acoustic noise that is heard by the user. Once again, a coherence estimator and gain controller (similar to the coherence-based gain controller 38 of FIG. 2) is coupled to the combiner 7 to adjust the weighting of each of the anti-noise signals, based on three un-weighted reference signals and based on the estimated disturbance.

Figure 4:
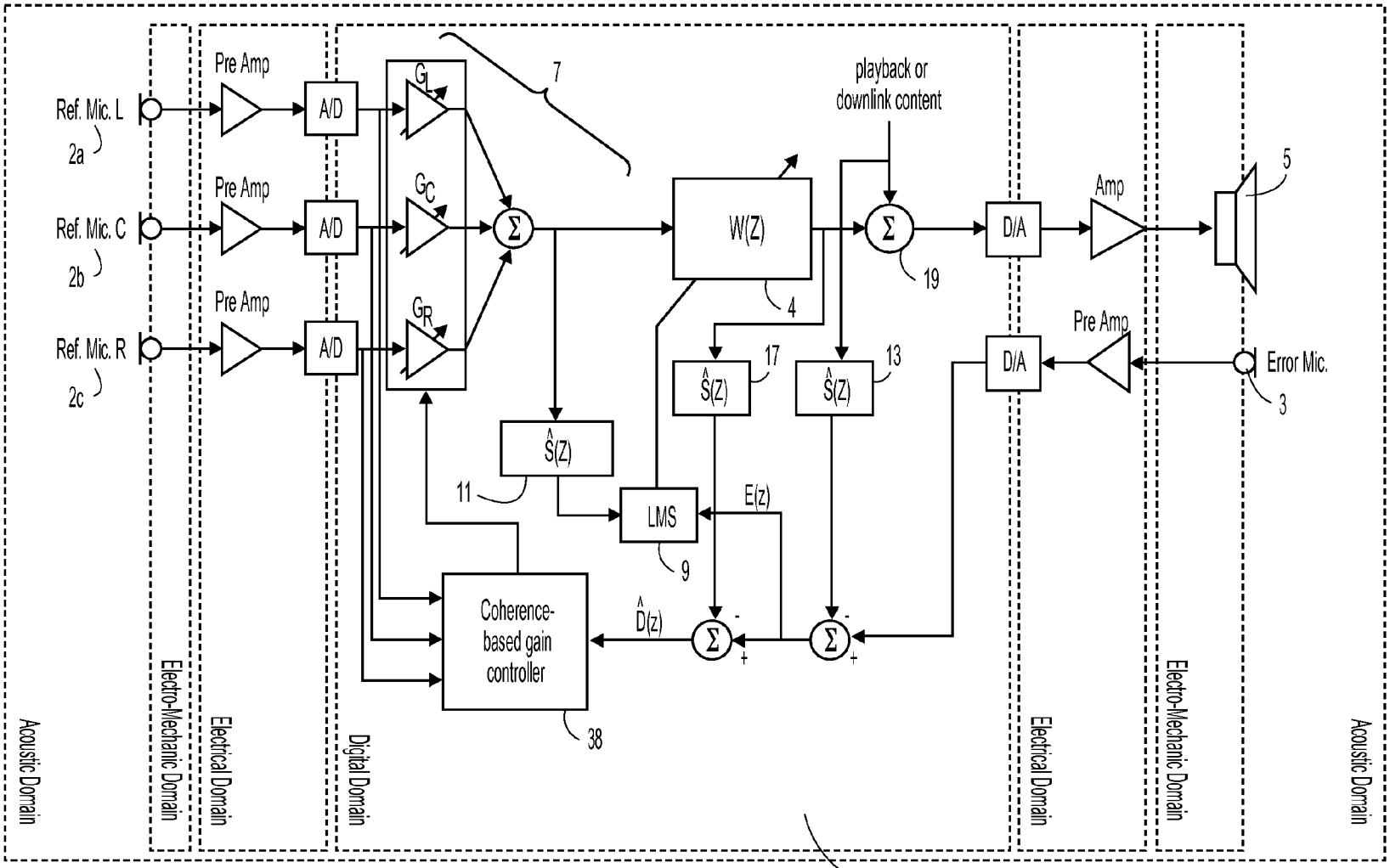
FIG. 4 is a block diagram of an ANC processor in accordance with yet another embodiment of the invention.

FIG. 4 is a block diagram of an ANC processor in accordance with yet another embodiment of the invention. Here, the combiner 7 is to produce a weighted sum of the reference microphone signals (rather than the component anti-noise signals), to produce a single, weighted sum reference signal at the reference input of the W(z) adaptive filter 4 as shown. The weighted sum reference signal is in this case pre-filtered by the Ŝ filter block 11 (in accordance with the filtered-x adaptive algorithm) and may optionally be pre-shaped by a pre-shaping filter (not shown), before arriving at the reference input of the adaptive controller 9. If pre-shaping is applied to the reference input, then a suitable pre-shaping filter should also be applied to the signal at the error input of the controller 9, to maintain balance of the adaptive algorithm engine. The adaptive filter 4 thus produces an anti-noise signal using the weighted sum reference signal, which is then converted into anti-noise sound through the speaker 5. The adaptive filter controller 9 (here, an LMS engine) adjusts the adaptive filter 4 based on input from the weighted sum reference signal, as filtered through an Ŝ(z) copy filter block 11, and based on an error signal. The latter is derived from the output of the error microphone 3. The coherence-based gain controller 38 is again present, this time however designed to adjust the weighting of each of the reference microphone signals, based on computing a measure of coherence between the unweighted reference signals R, L and C and the disturbance estimate D_hat(z).

Referring back to the embodiments of FIG. 2 and FIG. 3 where each of the component anti-noise signals is separately weighted by a respective gain value G being a full frequency band scaling factor, in these embodiments the error input to the adaptive algorithm engine (in each adaptive filter controller 9*a*, 9*b*) is an adjusted version of the error signal E(z), where this adjustment is designed to counteract the weighting of the anti-noise signals by the combiner 7. In particular, the ANC processor of FIG. 2 has an adaptive gain control block 39 which now also includes error signal correction gain blocks 40*a*, 40*b* where each receives its respective, un-weighted anti-noise signal (as shown). The outputs of the gain blocks 40*a*, 40*b* are then combined and filtered by S_hat(z) filter 42 which is a copy of the estimate of the secondary path, S(z), before being combined with the error signal E(z) at the input of the adaptive controller 9. FIG. 3 also has a similar error signal correction block, and in particular three correction gain blocks 40*a*, 40*b*, 40*c* having gain values $(1-G_L)$, $(1-G_C)$, and $(1-G_R)$, respectively, and feeding a summing junction which in turn feeds the S_hat(z) filter 42. Such an adjustment to the error signal can be seen to counteract the weighting by the combiner 7. For example, if a reduction is desired for channel 1, say $G_1=0.8$, while channel 2 is enhanced by $G_2=1.2$, then the correction to the error signal E(z) by the adaptive gain control block 39 will add $1-G_1=0.2$ to the channel 1 anti-noise and $1-G_2=-0.2$ to the channel 2 anti-noise (at the error inputs of the adaptive filter algorithm engines). This achieves the two-fold result of a modification to the anti-noise as "heard" by the user, but without affecting the normal operation of the adaptive filter algorithms. Thus, what the user experiences in terms of noise cancellation will change, in accordance with the weighting imparted by the combiner 7 upon the anti-noise, while the adaptive filter algorithms in the controllers 9*a*, 9*b* will continue to converge on a solution defined in accordance with a residual noise or error input that is unaffected by the weighting. Without such counteraction, the adaptive algorithm engines may inherently "undo" or negate the effect of the weighting (by the combiner 7.)

Another example set of weightings for the combiner 7 of a dual reference channel ANC system are $G_1=1$ and $G_2=1$, i.e., no gain and no attenuation for either channel. In that case, the error signal correction gain blocks 40*a*, 40*b* each present a zero output, so that no correction is made to E(z). In yet another example, when an actual gain is desired for one channel, e.g., $G_1=1.25$, then the other channel should be attenuated, namely $G_2=0.75$, i.e., a 25% gain on channel 1 means that there will be a 25% attenuation on channel 2, so the sum $G_1+G_2=2$. In this case, the error signal correction gain blocks compensate by reducing the channel 1 content by 0.25 and enhance the channel 2 content by 0.25, so the error input to the adaptive algorithm engines remains the same as if no weighting were being applied. Note that in the case of a three-channel system (three distinct reference microphone signal paths—see FIG. 3), the weightings are selected such their sum $G_1+G_2+G_2=3$.

Note how as described earlier (in connection with FIG. 2), generally speaking the coherence-based gain controller 38 adjusts the weighting applied by the combiner 7, based on computing a measure of the coherence between content in the un-weighted reference signals $x_1$, $x_2$ and content in the error signal E(z). Now, E(z) can become very small when the adaptive filter algorithms converge on a solution, thereby making the computation of an accurate coherence value challenging. Rather than directly using E(z) in the coherence computation, FIGS. 2-4 illustrate the case where an estimate of the disturbance D(z) is used. The disturbance D(z) is the background acoustic noise or ambient sound that has leaked past the housing of the portable device and into the ear canal or pinna where it can of course be heard by the user, in the absence of anti-noise Y(z)—see FIG. 1. The estimate of the disturbance is labeled here as D_hat(z, ω), and in the time domain, d_hat[n]. FIG. 2 illustrates that the adaptive gain control block 39 may have a coherence-based gain controller 38 which receives the un-weighted reference signals $x_1$, $x_2$, and directly uses D_hat(z), instead of E(z) directly. D_hat(z) may be computed using a difference block as shown, that estimates the disturbance D(z) by subtracting an estimate of the anti-noise sound, Y_hat(z), from the error signal E(z). The estimate of the anti-noise can be obtained by passing the anti-noise signal from the output of the combiner 7 (prior to being combined with user playback content or user downlink content by summing junction 19) through S_hat(z) filter 17.

Figure 5A:
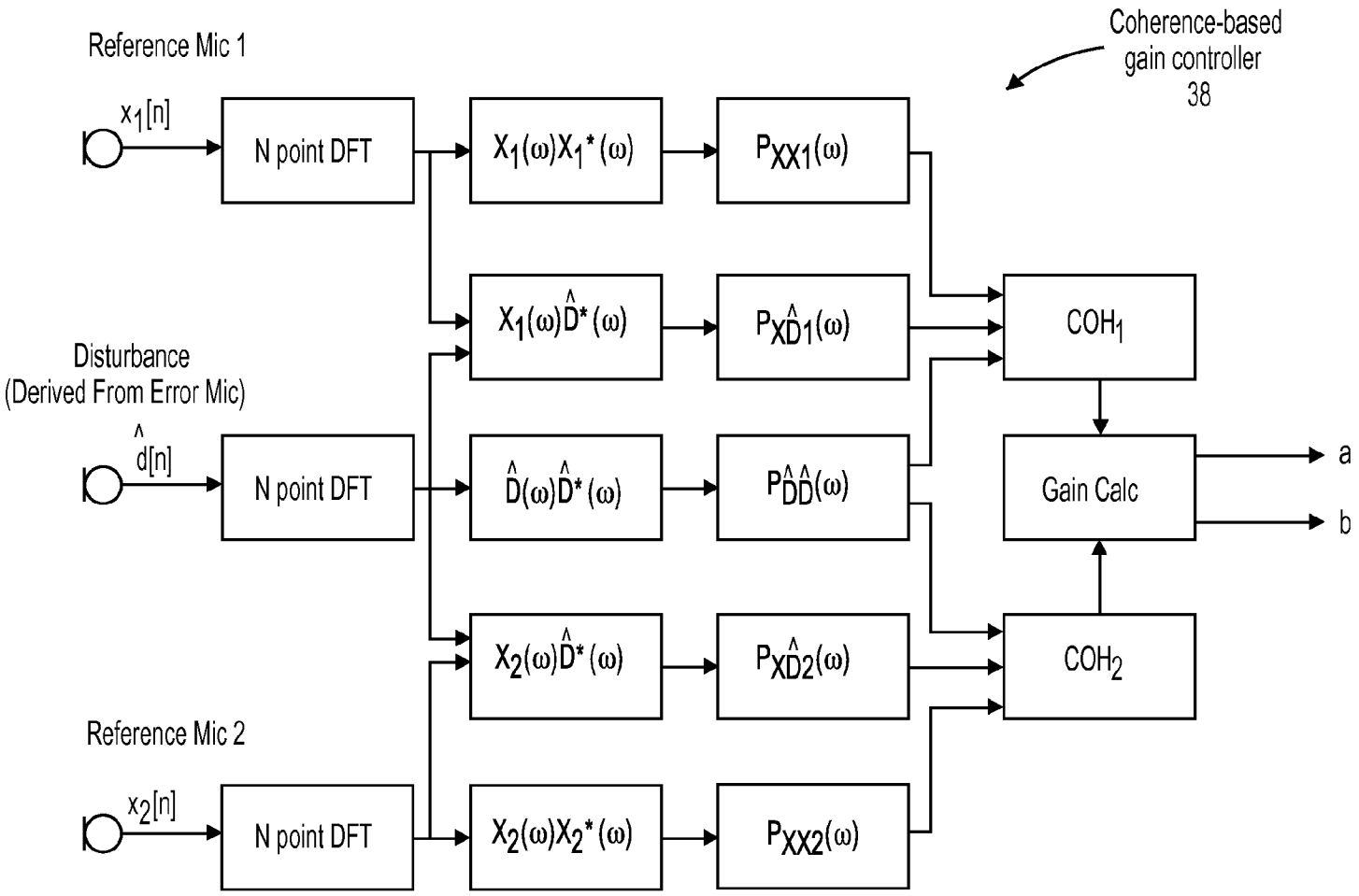
FIG. 5*a* depicts an example coherence-based gain controller.

An example of how to implement the coherence-based gain controller 38 for the case of a dual channel ANC processor is shown in FIG. 5*a*. In FIG. 5*a*, a measure of coherence is calculated in this example using frequency domain representations of signal power. The time domain signals from two reference microphones, $x_1$, $x_2$, are converted into the frequency domain and are used together with the frequency domain version of the estimated disturbance d_hat, to compute a coherence ratio. The example here uses an N point discrete fourier transform (DFT) however other frequency domain transforms are possible. An average coherence value over a given frequency range K can be computed for each channel, namely, $COH_1$, $COH_2$, using the following formulas:

$$COH_1 = \frac{1}{K}\sum_{k=k_1}^{k_2} \gamma_1^2(\omega),\ \omega = \frac{2\pi k}{N},\ K = k_2 - k_1$$

$$COH_2 = \frac{1}{K}\sum_{k=k_1}^{k_2} \gamma_2^2(\omega),\ \omega = \frac{2\pi k}{N},\ K = k_2 - k_1$$

where $$\gamma_1^2(\omega) = \frac{|P_{x\hat{d}1}(\omega)|^2}{P_{xx1}(\omega)P_{\hat{d}\hat{d}}(\omega)}$$

$$\gamma_2^2(\omega) = \frac{|P_{x\hat{d}2}(\omega)|^2}{P_{xx2}(\omega)P_{\hat{d}\hat{d}}(\omega)}$$

are magnitude squared coherence functions that are based on the regular and cross power spectral densities $$P_{xx1}(\omega) = \frac{1}{M}\sum_{m=0}^{M-1} X_1(\omega)X_1^*(\omega)$$

$$P_{xx2}(\omega) = \frac{1}{M}\sum_{m=0}^{M-1} X_2(\omega)X_2^*(\omega)$$

$$P_{\hat{d}\hat{d}}(\omega) = \frac{1}{M}\sum_{m=0}^{M-1} \hat{D}(\omega)\hat{D}^*(\omega)$$

-continued $$P_{x\hat{d}1}(\omega) = \frac{1}{M}\sum_{m=0}^{M-1} X_1(\omega)\hat{D}^*(\omega)$$

$$P_{x\hat{d}2}(\omega) = \frac{1}{M}\sum_{m=0}^{M-1} X_2(\omega)\hat{D}^*(\omega)$$

The above formulas for $COH_1$ and $COH_2$ may be viewed as the average coherence for each channel, with respect to the estimated disturbance D_hat. In one embodiment, the weighting or gain values a, b applied by the combiner 7 (of FIGS. 2-4) are respective, full frequency band scaling factors and can be calculated using the example formulas:

$$a = \frac{COH_1}{COH_1 + COH_2}$$

$$b = \frac{COH_2}{COH_1 + COH_2}$$

where b=1−a. Note that other ways of calculating the gain values a, b as representing the measures of coherence between their respective reference signals and the estimated disturbance are possible.

Figure 5B:
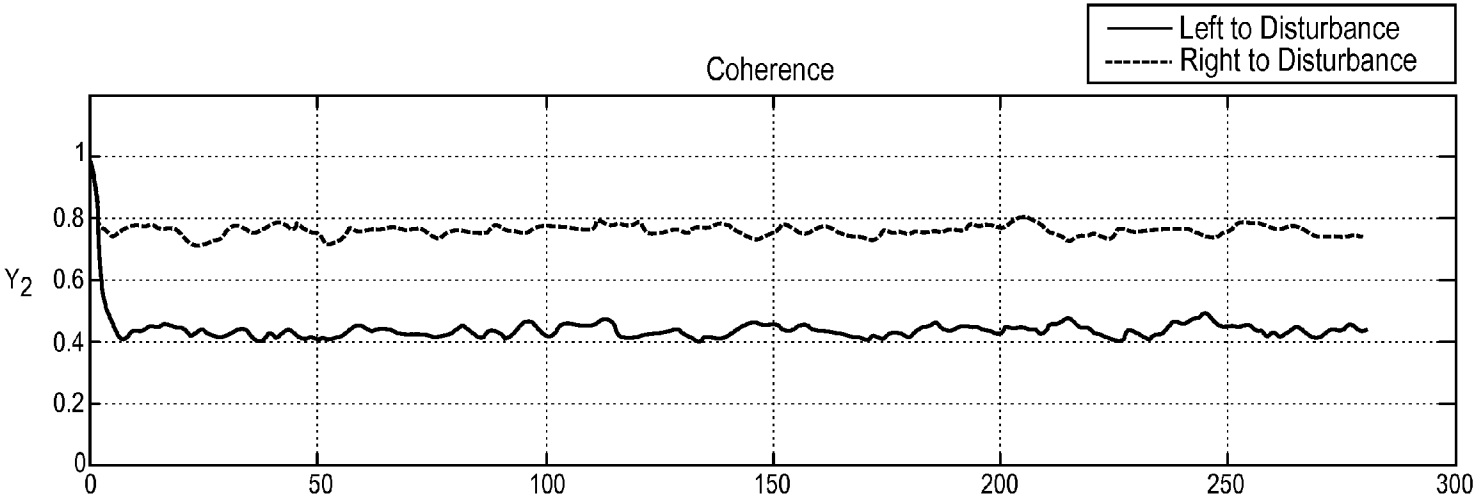
FIG. 5*b* shows an example of computed coherence versus time for a two-channel ANC system.
Figure 5C:
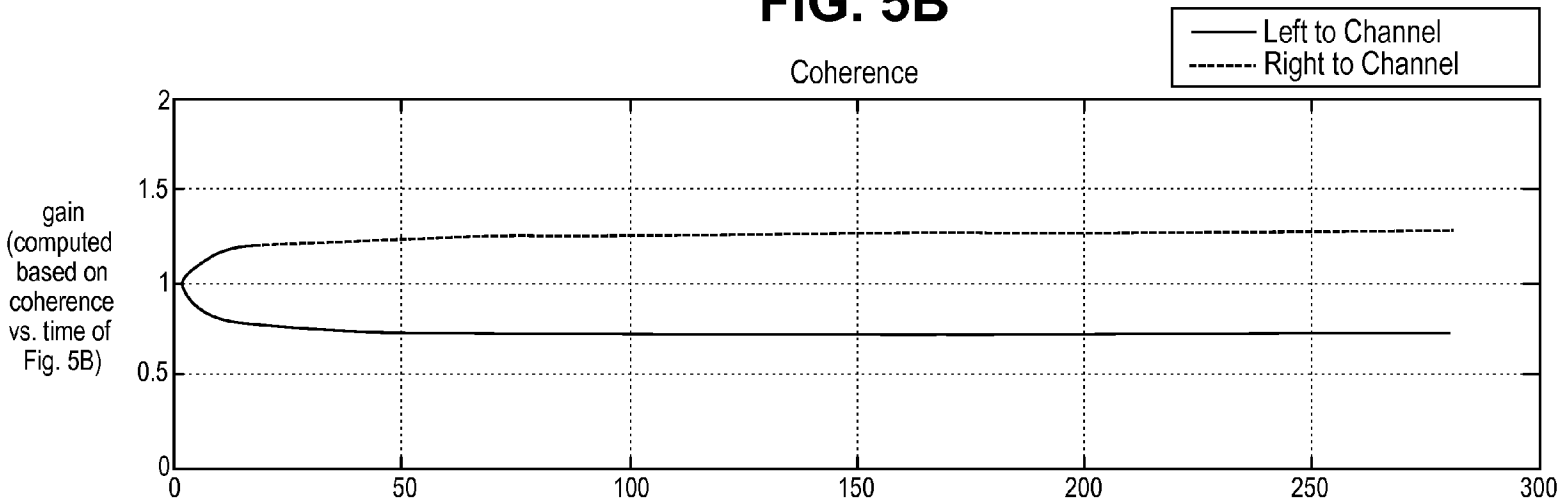
FIG. 5*c* shows a magnitude versus time graph of the gain parameters for the two-channels of the ANC system.

One example of these coherence-controlled gains can be seen in the graphs of FIG. 5*b* for the case of a two-channel ANC processor (left and right channels). In this example, the right channel has greater coherence to the estimated disturbance than the left channel, and as a result the gain calculations, which are shown in FIG. 5*c*, are such that the right channel is weighted more than the left channel. This means that the right channel will contribute more to the anti-noise than the left channel. This may correspond to the situation where, for example, the right earphone of a user wearing a headset is closer to or more directly in the path of an ambient noise source than the left earphone. It can be expected that if the user were to then turn around such that her left ear was facing the source of the ambient noise, then the system would adapt by first sensing that the average coherence of the left channel has become greater than that of the right channel, and then producing gain calculations in which the left channel is weighted more than the right channel.

Figure 6A:
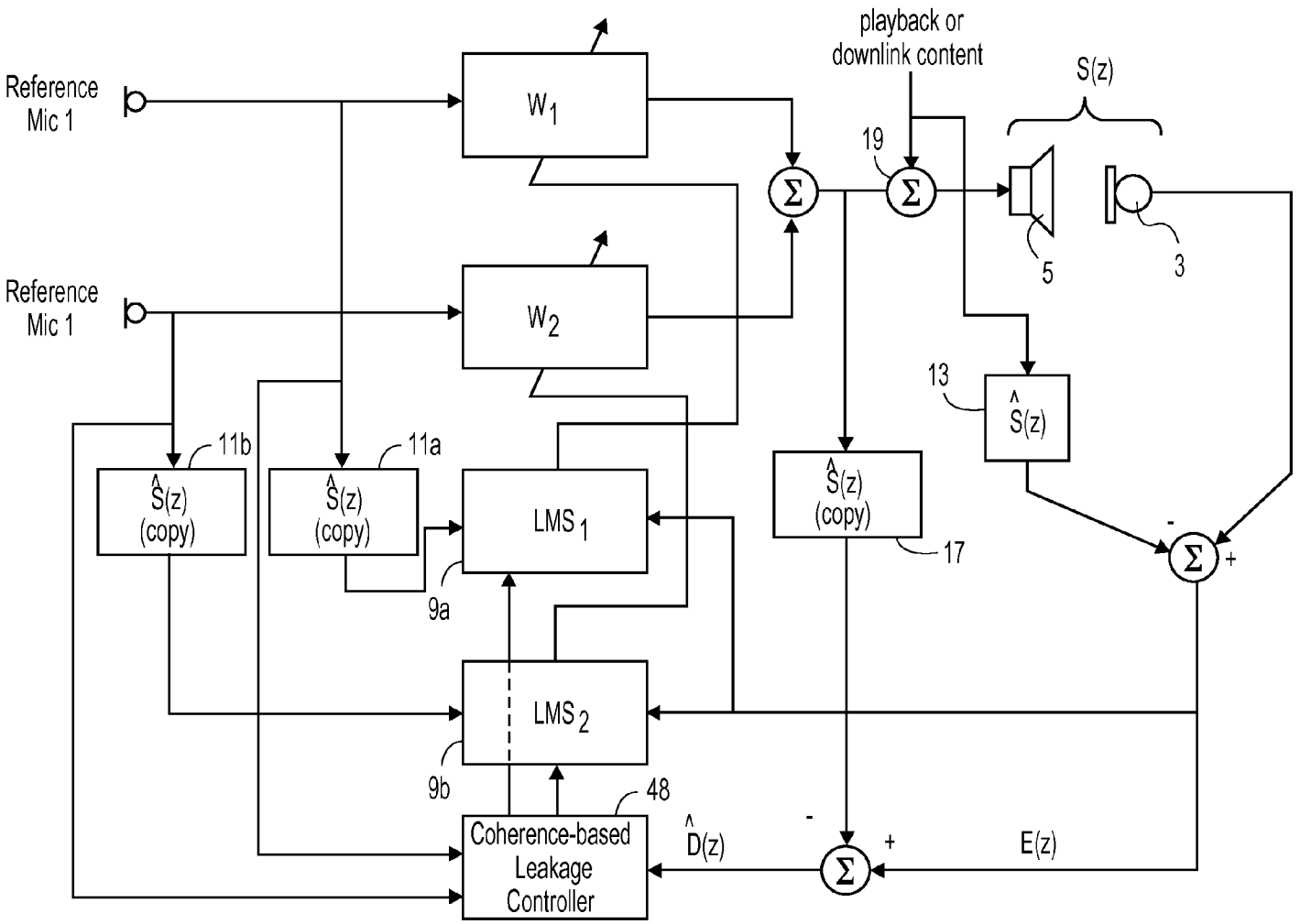
FIG. 6*a* is a block diagram of a multi-channel ANC processor that has multiple adaptive filters, and a coherence-based leakage controller for dynamically controlling how the adaptive algorithm engines compute updates to their adaptive filter coefficients.

Another method for controlling the strength of the anti-noise produced by a multi-channel ANC system, on a per-channel basis, is to control the adaptive filter algorithm engine of that channel directly, by controlling a leakage parameter (e.g., leakage coefficient) that is used by a "leaky" gradient descent algorithm, e.g., a leaky normalized least mean squares (NLMS) adaptive algorithm, of that channel. Referring now to FIG. 6*a*, in a leaky algorithm, a current digital filter coefficient of the W(z) adaptive filter 4 is computed based on weighting a prior coefficient. According to such an algorithm, the filter coefficients can be updated in accordance with the following example relationship:

$$W_k(n) \approx \text{alpha} * W_k(n-1) + \text{mu} * e(n) * x(n)$$

where $W_k(n)$ is the kth filter coefficient at time index n, and $W_k(n-1)$ is the same kth filter coefficient at the previous update; e(n) is the nth update to the ANC error or residual noise signal (which may be derived from the error microphone signal); x(n) is the nth update to the observed background or ambient noise signal, which may be derived from the reference microphone signal; mu, also referred to as step size, is a constant that controls convergence of the adaptive algorithm; and alpha is a weighting fraction (0<alpha<1) that when decreased serves to increase stability of the algorithm. Viewed another way, without loss of generality, alpha=1−leakage, 0<leakage<1, where leakage is a parameter or coefficient that is used to stabilize the adaptive algorithm and to reduce the unexcited modes of the solution. Increasing leakage will make the updated coefficients of the W filter smaller, slows down adaptation of the W filter, and also reduces the overall gain of the W filter. The latter effect is advantageously used in the embodiment of FIG. 6*a* to force a reduction or increase in the anti-noise of a given channel.

In FIG. 6*a*, relevant parts of a portable personal listening audio device are depicted as an ANC processor having multiple adaptive W filters $W_1$ and $W_2$, each to produce to a respective anti-noise signal using a respective one of the reference signals from the two reference microphones. The adaptive filter controllers in this case have LMS adaptive algorithm engines, each to adjust a respective one of the W filters based on input from the respective reference signal and from an error signal E(z). A summation block produces a sum of the anti-noise signals without altering their weighting (cf. the combiner 7 in the embodiments of FIGS. 2-3), where this combined anti-noise signal is once again to be converted to anti-noise sound so as to control a disturbance being background noise that is heard by a user.

In the embodiment of the FIG. 6*a*, a coherence-based leakage controller 48 is coupled to each of the adaptive filter controllers 9*a*, 9*b* to adjust the weighting factor, alpha, that is used by in this case the LMS algorithm engine of the adaptive filter controller 9, when the latter is computing an update to the filter coefficients of the respective $W_1$, $W_2$ filter. In one embodiment, the controller 48 determines alpha (or leakage) of each channel, responsive to computing a measure of coherence between content in the respective reference signal and content in the error signal.

The coherence-based leakage controller 48 may compute the measure of coherence between the respective reference signal and the error signal as follows. An estimate of the disturbance, D_hat(z), may be computed in the same manner as described earlier, for example using a difference block that has an input to receive the error signal and another input to receive a filtered version of the sum anti-noise signal that has been filtered in accordance with an estimate of a secondary path transfer function. A measure of coherence between the respective reference signal and the estimated disturbance is then computed, e.g., in accordance with the equations for $COH_1$ and $COH_2$ given above.

Figure 6B:
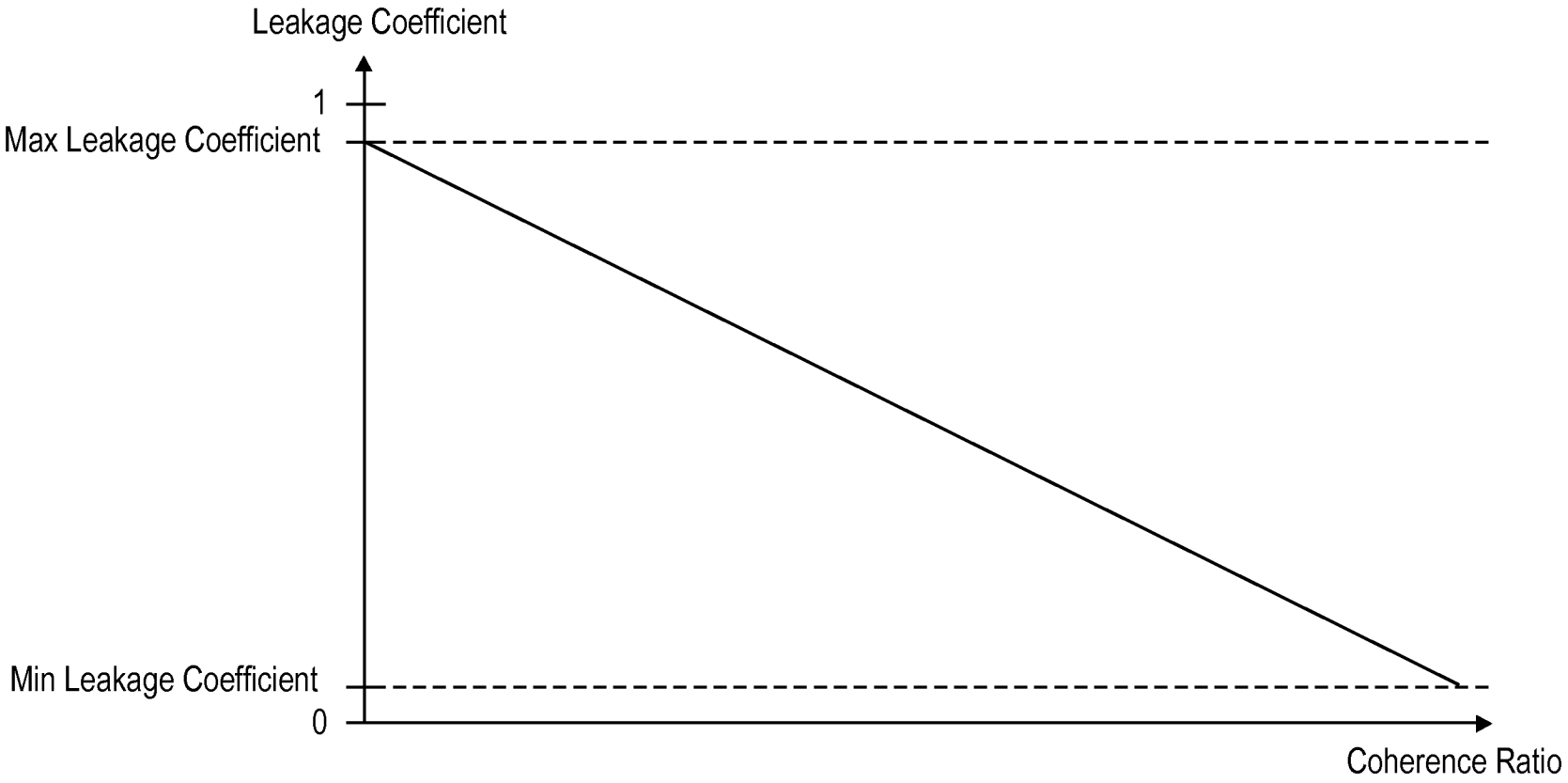
FIG. 6*b* illustrates an example relationship between a leakage parameter and a coherence parameter.

The coherence-based leakage controller 48 may also include a leakage calculator that determines a respective leakage parameter, to be used by the adaptive filter controller when updating the filter coefficients of its respective adaptive W filter, based on the computed measure of coherence. For example, the coherence-based leakage calculator may use a lookup table, or a mathematical formula, that relates a coherence parameter, representing coherence between the respective reference signal and the estimated disturbance, to the leakage parameter. The relationship may be such that the leakage parameter is determined to be small when the coherence parameter is large, and the leakage parameter is determined to be large when the coherence parameter is small. Such a relationship is depicted in the example of FIG. 6*b* as a linear relationship between a coherence ratio and a leakage coefficient, where the line has negative slope. Of course, the relationship need not be linear, although the generally negative slope is desirable as explained below.

As was explained earlier, in a multiple reference, multiple adaptive filter ANC processor, a reference path (or reference channel) exhibiting larger coherence than another reference path should have a smaller leakage parameter in its adaptive filter algorithm. In other words, the reference path that exhibits smaller coherence should have a larger leakage parameter. However, in one embodiment of the invention, for a dual adaptive filter ANC processor, the leakage in neither of the channels should be zero, since at least some (small) amount of leakage is usually needed in both channels in order to assist in maintaining stability of the adaptive algorithm. This is referred to in FIG. 6*b* as a "minimum leakage coefficient".

In another embodiment of the invention, at least one of the two or more paths of a multi-reference, multiple adaptive filter ANC processor always has at least a certain amount of leakage, to ensure some desired amount of ANC effect. In that case, the reference path with the higher coherence (or highest coherence) should be the one that has the minimum leakage coefficient. The leakage for the other path (having smaller coherence) should be computed according to some function that would increase the leakage for example in proportion to the coherence ratios a, b given above, e.g. FIG. 6*b*. A process for such an embodiment of the invention may proceed as follows: compute two Coherence values $COH_1$ and $COH_2$ for the reference Paths 1 and 2; compute the Coherence Ratios, a and b per the above listed equations; compute a leakage coefficient based on the smaller of the two Coherence Ratios (a and b); set the predetermined Min Leakage Coefficient for the path having higher Coherence, and the above computed leakage for the path with smaller Coherence; and finally use the two set leakage coefficients in their respective filter coefficient update equations. In this manner, the path with higher Coherence will always have Min Leakage applied, and the other one will have leakage computed based on its Coherence. The path with higher Coherence will see its respective adaptive filter algorithm adapting quickly, and the higher leakage in the other path will ensure that that path's effect is reduced.

A method for active noise cancellation in a portable personal listening audio device may proceed as follows (note however that the actual order of the following operations may be different in practice): component anti-noise signals are produced using adaptive filters and reference signals, respectively, wherein the reference signals reflect pickup of background sound by microphones, respectively, of the personal listening audio device; coefficients of the adaptive filters are adjusted based on input from the reference signals and based on input from a signal from an error microphone; a respective measure of coherence between content in each of the reference signals and content in the signal from the error microphone is computed; a weighted sum of the component anti-noise signals is produced wherein weighting of the component anti-noise signals changes as a function of the computed respective measure of coherence. In a further embodiment, an estimate of a disturbance, being the background sound as would be heard by a user of the portable personal listening audio device while excluding the effect of the anti-noise, is computed using the signal from the error microphone. More specifically, to compute the respective measure of coherence, a measure of coherence between the respective reference signal and the estimated disturbance is computed. In a further embodiment, an error signal, derived from the signal from the error microphone and used by the adaptive filter algorithms when adjusting or updating of the coefficients of the adaptive filters, is adjusted to counteract the weighting of the component anti-noise signals.

Another method for active noise cancellation in a portable personal listening audio device may proceed as follows (and once again the order in which the following operations occur may be different in practice): component anti-noise signals are produced using adaptive filters and reference signals, respectively; coefficients of the adaptive filters are updated based on input from the reference signals and based on input from a signal from an error microphone; a respective measure of coherence is computed between content in each of the reference signals and content in the signal from the error microphone, and in response a weighting factor used when updating the coefficients of the adaptive filters is adjusted; the component anti-noise signals are combined to produce anti-noise sound in an ear canal of a user of the device. Note that in one aspect, an estimate of a disturbance, being background sound as would be heard by the user of the portable listening audio device, is computed using the signal from the error microphone. The respective measure of coherence is then computed between the respective reference signal and the estimated disturbance.

Figure 7:
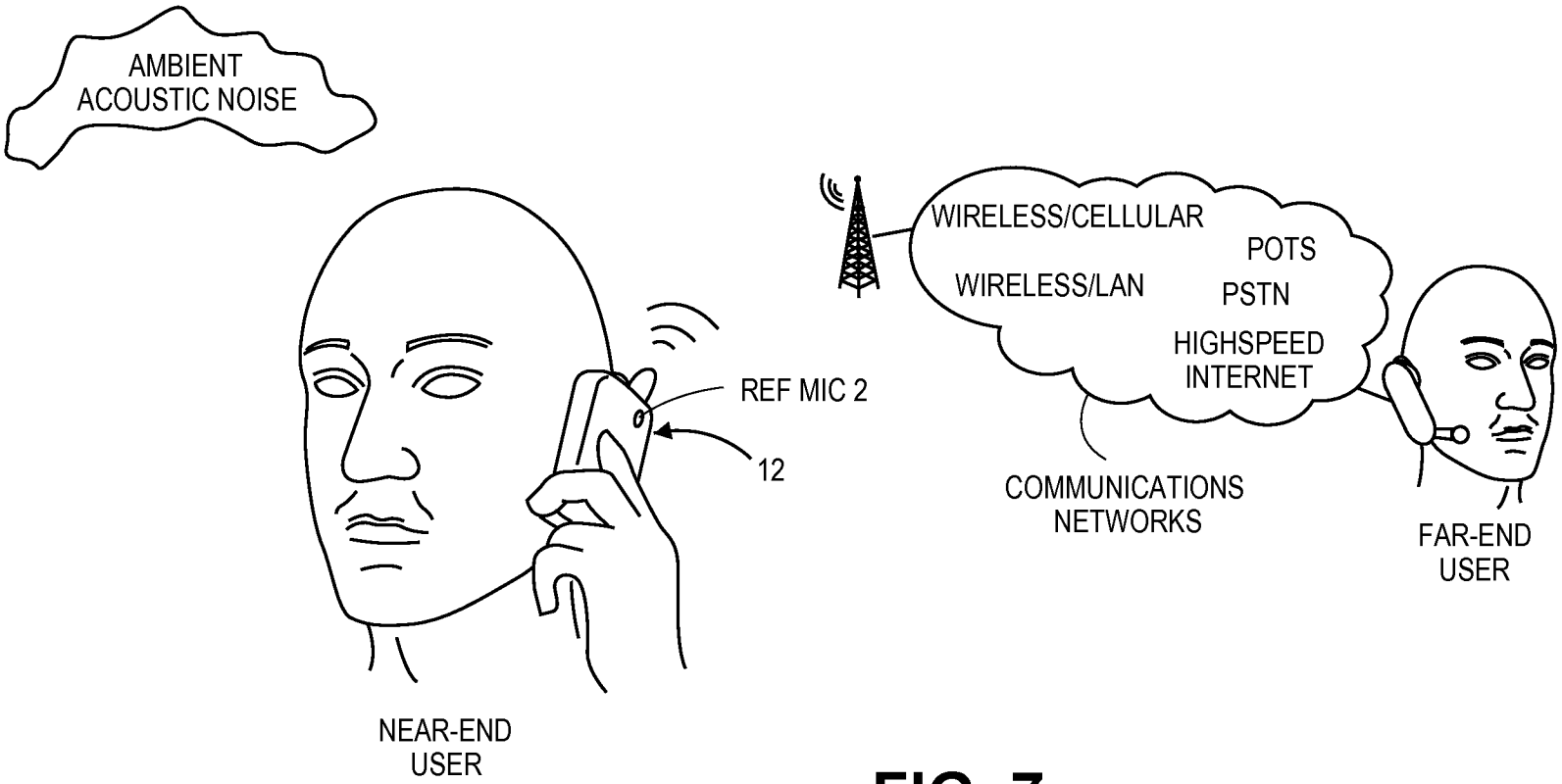
FIG. 7 shows an example of an end-user acoustic environment and consumer electronics personal listening device.

FIG. 7 illustrates an example of an end-user acoustic environment and consumer electronics product application of the ANC system. A near-end user is holding a mobile communications handset device 12 such as a smart phone or a multi-function cellular phone. The ANC processor 1, the reference microphones 2 and the error microphone 3 (as well as the related processes described above) can be implemented in such a personal audio device. The near-end user is in the process of a call with a far-end user who is also using a user or personal communications device. The terms "call" and "telephony" are used here generically to refer to any two-way real-time or live audio communications session with a far-end user (including a video call which allows simultaneous audio). The term "mobile phone" is used generically here to refer to various types of mobile communications handset devices (e.g., a cellular phone, a portable wireless voice over IP device, and a smart phone). The mobile device 12 communicates with a wireless base station in the initial segment of its communication link. The call, however, may be conducted through multiple segments over one or more communication networks 3, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

The mobile device 12 has an exterior housing in which are integrated an earpiece speaker (which may be the speaker 5—see FIG. 1) near one side of the housing, and a primary handset (or talker) microphone 6 that is positioned near an opposite side of the housing. The mobile device 12 may also have at least two references microphone 2 located on a side and rear face of the housing and generally aimed in a different direction than the primary microphone 6, so as to better pickup the ambient sounds.

Figure 8:
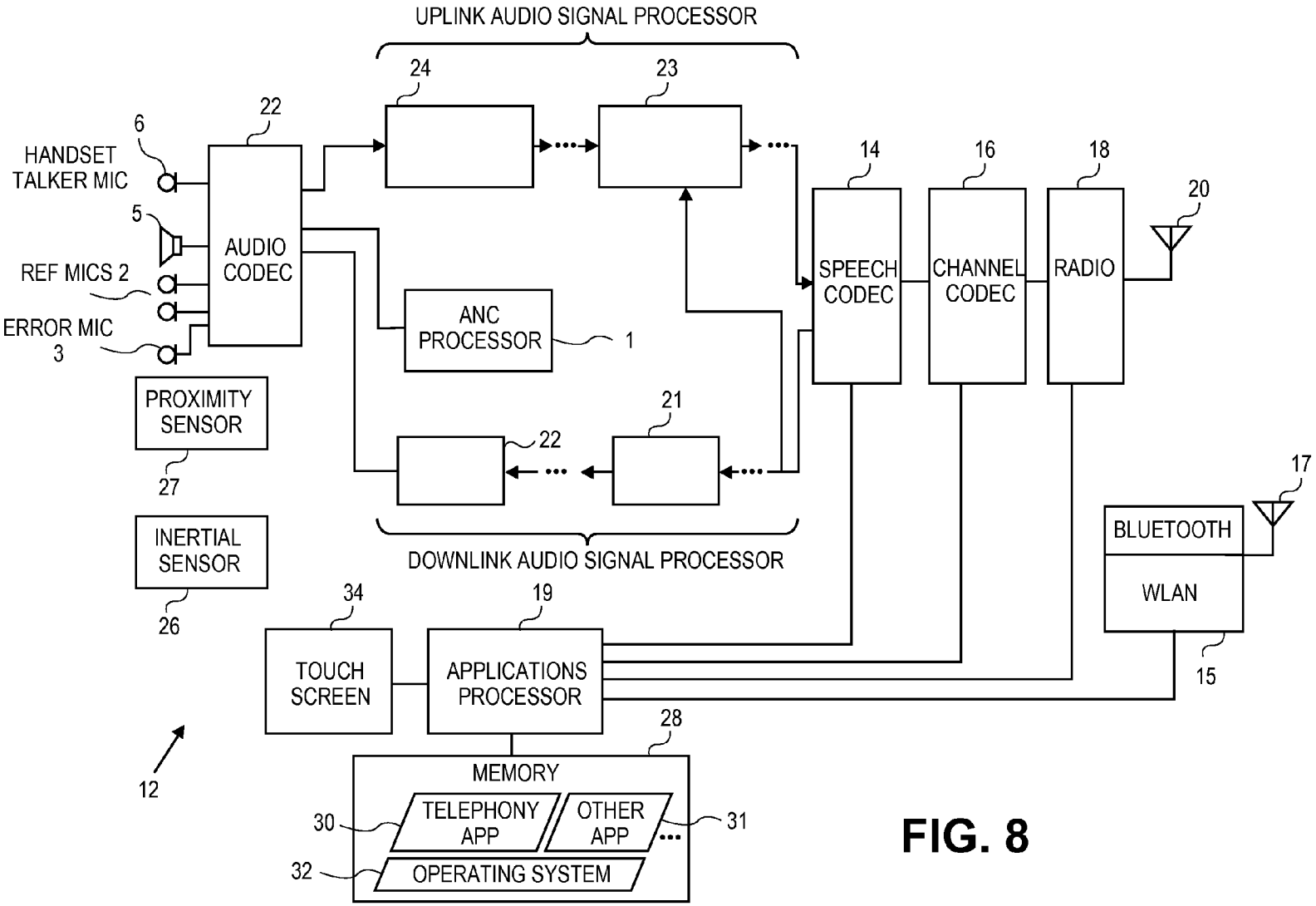
FIG. 8 is a block diagram of some relevant constituent components of a personal mobile communications device, such as a smart phone, in which an ANC processor may be implemented.

A block diagram of some of the functional unit blocks of the mobile device 12 is shown in FIG. 8. These include constituent hardware components such as those, for instance, of an iPhone™ device by Apple Inc. Although not shown, the mobile device 12 has a housing in which the primary mechanism for visual and tactile interaction with its user is a touch sensitive display screen (touch screen 34). As an alternative, a physical keyboard may be provided together with a display-only screen. The housing may be essentially a solid volume, often referred to as a candy bar or chocolate bar type, as in the iPhone™ device. Alternatively, a moveable, multi-piece housing such as a clamshell design or one with a sliding physical keyboard may be provided. The touch screen 34 can display typical user-level functions of visual voicemail, web browser, email, digital camera, various third party applications (or "apps"), as well as telephone features such as a virtual telephone number keypad that receives input from the user via touch gestures.

The user-level functions of the mobile device 12 are implemented under the control of an applications processor 19 or a system on a chip (SoC) processor that is programmed in accordance with instructions (code and data) stored in memory 28 (e.g., microelectronic non-volatile random access memory). The terms "processor" and "memory" are generically used here to refer to any suitable combination of programmable data processing components and data storage that can implement the operations needed for the various functions of the device described here. An operating system 32 may be stored in the memory 28, with several application programs, such as a telephony application 30 as well as other applications 31, each to perform a specific function of the device when the application is being run or executed. The telephony application 30, for instance, when it has been launched, unsuspended or brought to the foreground, enables a near-end user of the mobile device 12 to "dial" a telephone number or address of a communications device of the far-end user, to initiate a call, and then to "hang up" the call when finished.

The applications processor 19, while running the telephony application program 30, may conduct the call by enabling the transfer of uplink and downlink digital audio signals (also referred to here as voice or speech signals) between itself or the baseband processor on the network side, and any user-selected combination of acoustic transducers on the acoustic side. The downlink signal carries speech of the far-end user during the call, while the uplink signal contains speech of the near-end user that has been picked up by the handset talker microphone 6.

The analog-digital conversion interface between the acoustic transducers and the digital downlink and uplink signals may be accomplished by an audio codec 22. The acoustic transducers include an earpiece speaker (also referred to as a receiver) which may be the speaker 5, a loud speaker or speaker phone (not shown), one or more microphones including the talker microphone 6 that are intended to pick up the near-end user's speech primarily, a secondary microphone such as reference microphone 2 that is primarily intended to pick up the ambient or background sound, and the error microphone 3. The audio codec 22 may interface with the ANC processor 1 as shown, in that it outputs or provides the digital audio signals of reference microphone 2 and the error microphone 3 to the ANC processor 1, while receiving the anti-noise signal from the ANC processor 1. The audio codec 22 may then mix the anti-noise signal with the downlink audio (coming from the downlink audio signal processing chain), using a mixer 19—see FIG. 2—prior to driving a power amplifier that in turn drives the speaker 5.

In accordance with another embodiment of the invention, the mobile device 12 may have stored therein software code that when executed by a processor of the device 12 enables the user to manually set an overall weighting by the combiner 7 (see, e.g., FIGS. 2-4) through a touchscreen user interface slider (not shown.) The range of the slider can be mapped to a range from no ANC (essentially zero weighting on all anti-noise production) to full strength ANC (enabling full strength and automatic control of the weighting by the processes described above.) The mapping could, for example, result in a linear or other gradual translation from the touchscreen slider to a scaling factor between 0 and 1 that is applied to the output anti-noise signal, just before input to the speaker driver 5.

Figure 9:
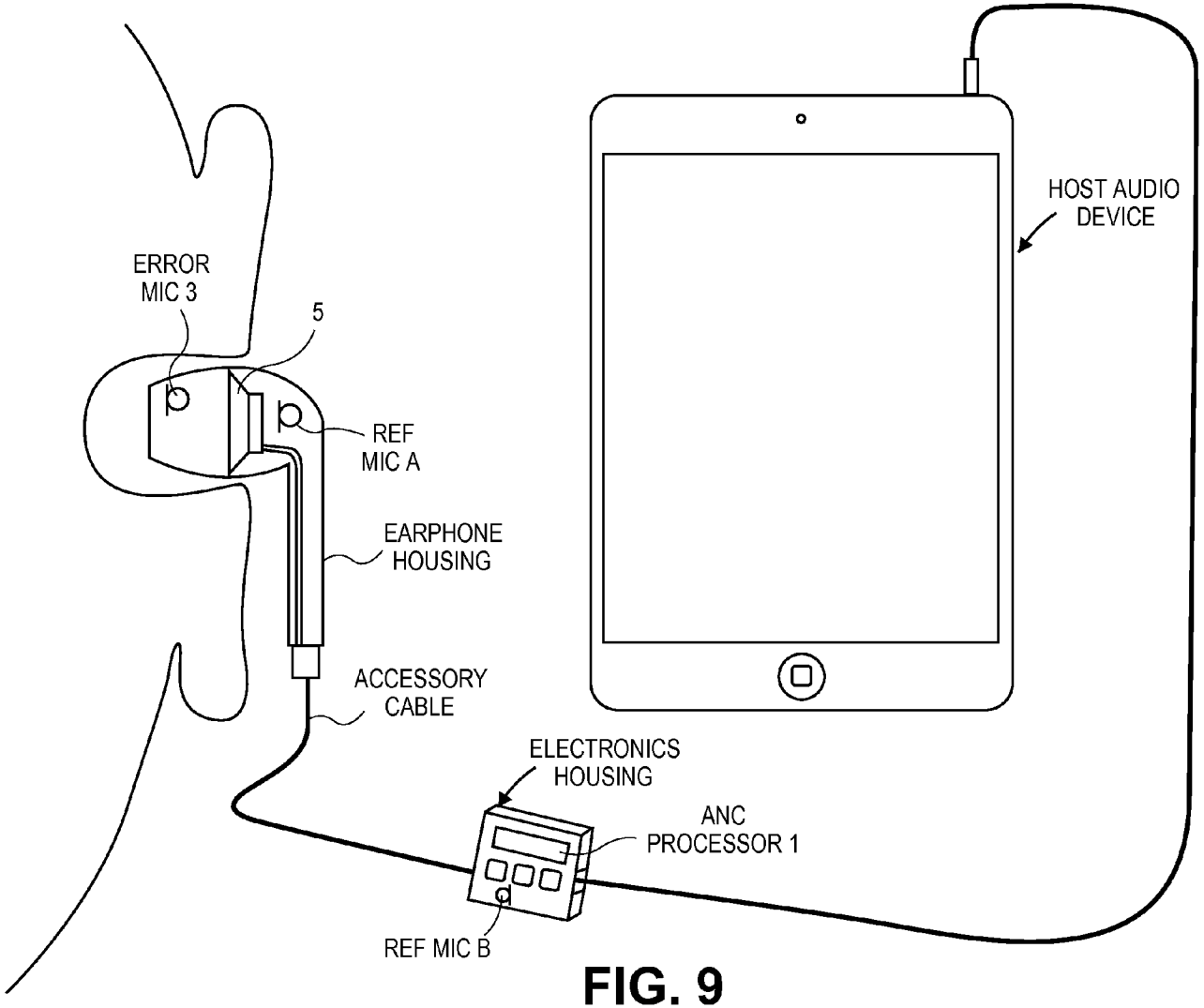
FIG. 9 illustrates another consumer electronics listening device in which the ANC system may be implemented.

FIG. 9 illustrates another consumer electronic listening product in which an ANC system may be implemented. A host audio device is shown, in this example being a tablet computer, which has a peripheral connector to which a headset is electrically connected via an accessory cable. The headset may include an in-the-ear earphone as shown, having an earphone housing in which the error microphone 3 and one of two reference microphones 2 (in this example ref mic A) are integrated. The speaker 5 in this case is a small or miniature speaker driver suitable for use within an earphone. In this case, the second reference microphone, ref mic B, is located on the accessory cable somewhere between the earphone housing and the connector that is attached to the host audio device. Communication or signaling wires may connect the error microphone 3, ref mic A, ref mic B, and speaker 5 to the ANC processor 1 which in this case is integrated within a separate electronics housing (separate from the host device housing and the earphone housing) that is attached to the accessory cable. It is expected that the ANC processor 1 together with other electronics within this housing may receive dc power from a power supply circuit within the battery-powered host audio device, via the accessory cable. Other system applications of the ANC system within the realm of consumer electronics personal listening devices are possible.

As explained above, an embodiment of the invention may be a machine-readable medium (such as microelectronic memory) having stored thereon instructions, which program one or more data processing components (generically referred to here as a "processor") to perform the digital audio processing operations described above in connection with the ANC processor 1 including noise and signal strength measurement, filtering, mixing, adding, inversion, comparisons, and decision making. In other embodiments, some of these operations might be performed by specific hardware components that contain hardwired logic (e.g., dedicated digital filter blocks and hardwired state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For instance, while the embodiment of FIG. 2 uses two reference microphones 2, and the embodiments of FIGS. 3-4 use three reference microphones, the techniques described here could be used for an ANC system that uses four or more microphones provided that typical power consumption limits for portable devices can be met. The description is thus to be regarded as illustrative instead of limiting.

What is claimed is:

1. A portable personal listening audio device, comprising:

active noise cancellation (ANC) circuitry having a plurality of adaptive filters each to produce a respective anti-noise signal using a respective one of a plurality of reference signals, a plurality of adaptive filter controllers, wherein each controller is to adjust a respective one of the adaptive filters based on input from the respective reference signal and an error signal, a combiner to produce a weighted sum of the anti-noise signals, and an adaptive gain control block coupled to the combiner to adjust the weighting of each of the anti-noise signals based on coherence between content in a respective one of the reference signals and in the error signal; and an earpiece speaker having an input to receive the weighted sum of the anti-noise signals and to produce an anti-noise sound within an ear of a user of the portable personal listening audio device when the earpiece speaker is placed adjacent the ear of the user.

2. The device of claim 1 further comprising:

a plurality of reference microphones to pick up ambient sound outside of the device, which is represented in the plurality of reference signals, respectively; and an error microphone to pick up residual acoustic noise in the ear of the user, where the residual acoustic noise is represented in the error signal.

3. The device of claim 1 wherein the adaptive gain control block is to compute a respective measure of coherence between content in a respective one of the reference signals and in an estimate of a disturbance derived from the error signal, and on that basis adjust the weighting of the respective anti-noise signal.

4. The device of claim 3 wherein the combiner is to produce the weighted sum of the anti-noise signals by applying a respective, full frequency band gain or scaling factor to the respective anti-noise signal, and wherein the adaptive gain control block comprises a coherence-based gain controller that computes the respective scaling factor.

5. The device of claim 1 further comprising an error signal correction block to adjust the error signal, before input to the adaptive filter controllers, so as to counteract the combiner's weighting of the anti-noise signals.

6. The device of claim 5 wherein the error signal block comprises a plurality of variable gain blocks each to apply a gain, to a respective one of the anti-noise signals, that is complementary to the weighting applied by the combiner to said one of the anti-noise signals.

7. The device of claim 2 further comprising a mobile phone handset housing in which the earpiece speaker is installed as a receiver, together with one of the plurality of reference microphones and the error microphone.

8. The device of claim 2 further comprising an earphone housing in which the earpiece speaker is integrated together with the error microphone and one of the plurality of reference microphones.

9. A portable personal listening audio device, comprising:

active noise cancellation (ANC) circuitry having a combiner to produce a weighted sum of a plurality of reference signals, an adaptive filter to produce an anti-noise signal using the weighted sum reference signal to control a disturbance being ambient sound that is heard by a user, an adaptive filter controller to adjust the adaptive filter based on input from the weighted sum reference signal and an error signal, and an adaptive gain control block coupled to the combiner to compute a measure of coherence between content in a respective one of the reference signals and in the error signal and on that basis adjust a weighting of the respective reference signal; and an earpiece speaker having an input to receive the anti-noise signal and to produce an anti-noise sound within an ear of a user of the portable personal listening audio device when the earpiece speaker is placed adjacent the ear of the user.

10. The device of claim 9 wherein the adaptive gain control block comprises a coherence-based gain controller that receives the reference signals, and a difference block that estimates the disturbance by subtracting an estimate of the anti-noise sound from the error signal.

11. A portable personal listening audio device comprising:

an active noise cancellation (ANC) processor having:

a plurality of adaptive filters, each to produce to a respective anti-noise signal using a respective one of a plurality of reference signals, a plurality of adaptive filter controllers, each to adjust a respective one of the adaptive filters, based on input from the respective reference signal and from an error signal, a combiner to produce a sum of the anti-noise signals, and a coherence-based leakage control block that is coupled to each of the adaptive filter controllers to adjust a weighting factor used by the adaptive filter controller when computing an update to filter coefficients of the respective adaptive filter, responsive to computing a measure of coherence between content in the respective reference signal and content in the error signal; and an earpiece speaker having an input to receive the sum of the anti-noise signals and to produce an anti-noise sound within an ear of a user of the portable personal listening audio device when the earpiece speaker is placed adjacent the ear of the user.

12. The device of claim 11 wherein the coherence-based leakage control block is to compute said measure of coherence between the respective reference signal and the error signal by computing an estimate of a disturbance, using the error signal, and computing a measure of coherence between the respective reference signal and the estimated disturbance.

13. The device of claim 12 wherein the coherence-based leakage control block comprises a coherence-based leakage calculator that determines a respective leakage parameter to be used by the adaptive filter controllers when updating the filter coefficients of the respective adaptive filter, and a difference block having an input to receive the error signal and another input to receive a filtered version of the sum anti-noise signal that has been filtered in accordance with an estimate of a secondary path transfer function.

14. The device of claim 13 wherein the coherence-based leakage calculator comprises one of a lookup table and a mathematical formula that relates a coherence parameter, representing coherence between the respective reference signal and the estimated disturbance, to the leakage parameter in such a way that the leakage parameter is determined to be small when the coherence parameter is large and the leakage parameter is determined to be large when the coherence parameter is small.

15. A method for active noise cancellation in a portable personal listening audio device, comprising:

producing a plurality of component anti-noise signals using a plurality of adaptive filters and a plurality of reference signals, respectively, wherein the reference signals reflect pickup of background sound by a plurality of microphones, respectively, of the personal listening audio device;

adjusting coefficients of the adaptive filters based on input from the reference signals and based on input from a signal from an error microphone;

computing a respective measure of coherence between content in each of the reference signals and content in the signal from the error microphone;

producing a weighted sum of the component anti-noise signals wherein weighting of the component anti-noise signals changes as a function of the computed respective measure of coherence; and receiving the weighted sum of the anti-noise signals with an earpiece speaker to produce an anti-noise sound within an ear of a user of the portable personal listening audio device when the earpiece speaker is placed adjacent the ear of the user.

16. The method of claim 15 further comprising computing an estimate of a disturbance, being the background sound as would be heard by a user of the portable personal listening audio device while excluding effects of anti-noise, using the signal from the error microphone, wherein computing the respective measure of coherence comprises computing a measure of coherence between the respective reference signal and the estimated disturbance.

17. The method of claim 15 further comprising producing an error signal from the signal from the error microphone, and adjusting the error signal to counteract the weighting of the component anti-noise signals, wherein adjusting the coefficients of the adaptive filters is based on the adjusted error signal.

18. The method of claim 15 further comprising:

receiving manual user input regarding active noise cancellation (ANC) strength that can be in a range of no ANC to full strength ANC;

mapping the received user input to a scaling factor; and applying the scaling factor to the weighted sum anti-noise signal.

19. A method for active noise cancellation in a portable personal listening audio device, comprising:

producing a plurality of component anti-noise signals using a plurality of adaptive filters and a plurality of the reference signals, respectively;

updating coefficients of the adaptive filters based on input from the reference signals and based on a signal from an error microphone;

computing a respective measure of coherence between content in each of the reference signals and content in the signal from the error microphone, and in response adjusting a weighting factor used when updating the coefficients of the adaptive filters;

combining the component anti-noise signals; and receiving the combined anti-noise signals with an earpiece speaker to produce an anti-noise sound within an ear canal of a user of the portable personal listening audio device when the earpiece speaker is placed adjacent the ear of the user.

20. The method of claim 19 further comprising computing an estimate of a disturbance, being background sound as would be heard by a user of the portable listening audio device, using the signal from the error microphone, wherein computing the respective measure of coherence comprises computing a measure of coherence between the respective reference signal and the estimated disturbance.

21. The method of claim 19 further comprising:

receiving manual user input regarding active noise cancellation (ANC) strength that can be in a range between no ANC and full strength ANC;

mapping the received user input to a scaling factor; and applying the scaling factor to the combined anti-noise signals.

* * * * *